US007178352B2

(12) United States Patent
Lifson

(10) Patent No.: US 7,178,352 B2
(45) Date of Patent: Feb. 20, 2007

(54) COMPRESSOR

(75) Inventor: Alexander Lifson, Manlius, NY (US)

(73) Assignee: Carrier Corporation, Syracuse, NY (US)

( * ) Notice: Subject to any disclaimer, the term of this patent is extended or adjusted under 35 U.S.C. 154(b) by 358 days.

(21) Appl. No.: 10/821,097

(22) Filed: Apr. 8, 2004

(65) Prior Publication Data

US 2005/0223726 A1 Oct. 13, 2005

(51) Int. Cl.
*F25B 41/00* (2006.01)
*F25B 49/00* (2006.01)
*F01C 1/08* (2006.01)

(52) U.S. Cl. ..... 62/196.2; 62/510; 418/196; 418/197; 418/201.1

(58) Field of Classification Search ..... 62/196.2, 62/510; 418/196, 197, 201.1
See application file for complete search history.

(56) References Cited

U.S. PATENT DOCUMENTS 2,481,527 A * 9/1949 Nilsson ..... 418/197
5,911,743 A * 6/1999 Shaw ..... 62/84
6,217,304 B1 * 4/2001 Shaw ..... 418/100
6,976,833 B2 * 12/2005 Daniels et al. ..... 418/197

* cited by examiner

*Primary Examiner*—Chen Wen Jiang
(74) *Attorney, Agent, or Firm*—Bachman & LaPointe, P.C.

(57) ABSTRACT

A compressor has at least three-rotors. A first compression path between first inlet and outlet ports is associated with interaction of the first and second rotors. A second compression path between second inlet and outlet ports is associated with interaction of the first and third rotors. At least partial independence of the ports permits the first and second inlet ports to be at a different pressure or the first and second outlet ports to be at a different pressure. Fully or partially separate circuits in a refrigeration or air conditioning system may be associated with the first and second compression paths.

20 Claims, 3 Drawing Sheets

COMPRESSOR

BACKGROUND OF THE INVENTION (1) Field of the Invention

The invention relates to compressors, and more particularly to screw-type compressors.

(2) Description of the Related Art

Screw-type compressors are commonly used in air conditioning and refrigeration applications. In such a compressor, intermeshed male and female lobed rotors or screws are rotated about their axes to pump the working fluid (refrigerant) from a low pressure inlet end to a high pressure outlet end. During rotation, sequential lobes of the male rotor serve as pistons driving refrigerant downstream and compressing it within the space (compression pocket) between an adjacent pair of female rotor lobes and the housing. Likewise sequential lobes of the female rotor produce compression of refrigerant within a male rotor compression pocket between an adjacent pair of male rotor lobes and the housing. In one implementation, the male rotor is coaxial with an electric driving motor and is supported by bearings on inlet and outlet sides of its lobed working portion. There may be multiple female rotors engaged to a given male rotor or vice versa. With such a compressor, male and female compression pockets may also have multiple inlet and outlet ports.

When a compression pocket is exposed to an inlet port, the refrigerant enters the pocket essentially at suction pressure. As the pocket continues to rotate, at some point during its rotation, the pocket is no longer in communication with the inlet port and the flow of refrigerant to the pocket is cut off. Typically the inlet port geometry is arranged in such a way that the flow of refrigerant is cut off at the time in the cycle when the pocket volume reaches its maximum value. Typically the inlet port geometry is such that both male and female compression pockets are cut off at the same time. The inlet port is typically a combination of an axial port and a radial port. After the inlet port is closed, the refrigerant is compressed as the pockets continue to rotate and their volume is reduced. At some point during the rotation, each compression pocket intersects the associated outlet port and the closed compression process terminates. Typically outlet port geometry is such that both male and female pockets are exposed to the outlet port at the same time. As with the inlet port, the outlet port is normally a combination of an axial port and a radial port. By combining axial and radial ports into one design configuration, the overall combined port area is increased, minimizing throttling losses associated with pressure drop through a finite port opening area. In an exemplary three-rotor configuration, the inlet and outlet ports are respectively formed at common inlet and outlet plenums.

The compressor may be designed and sized for its intended use (e.g., to provide a given compression or volume index and operate at a given flow at a given speed or combination thereof). Different compressors or at least different components (rotors, motors, and the like) may be required for different uses.

SUMMARY OF THE INVENTION

One aspect of the invention involves an apparatus comprising: a first rotor enmeshed with second rotors. The rotors are held within a housing for rotation about respective first, second, and third axes. The housing has: a first surface cooperating with the first and second rotors to define a first inlet port; a second surface cooperating with the first and second rotors to define a first outlet port; a third surface cooperating with the first and third rotors to define a second inlet port; and a third surface cooperating with the first and third rotors to define a second outlet port. Either the first and second inlet ports are at a different pressure or the first and second outlet ports are at a different pressure.

In various implementations, the apparatus may further include: a first condenser; a first evaporator; and one or more first conduits coupling the first condenser and the first evaporator to the housing to define a first flowpath from the first outlet port through the first evaporator and first condenser and to the first inlet port. The apparatus may further include: a second condenser; a second evaporator; and one or more second conduits coupling the second condenser and the second evaporator to the housing to define a second flowpath from the second outlet port through the second evaporator and second condenser and to the second inlet port.

The first outlet port may be at the same pressure as the second inlet port. The apparatus of may further include a first condenser, a first expansion device, and a first evaporator. One or more first conduits may couple the first condenser, the first expansion device and the first evaporator to the housing to define a first flowpath from the second outlet port to the first inlet port. There may be no economizer branches off the first flowpath. There may be an economizer heat exchanger having a first leg along the first flowpath and a second leg, in heat exchange relation with the first leg. The second leg may be along a diversion flowpath from a location along the first flowpath between the first condenser and the first leg to join a second flowpath from the first outlet port to the second inlet port.

Either the first and second inlet ports may form a common inlet port or the first and second outlet ports may form a common outlet port. Either the first and second inlet ports may be at like pressure or the first and second outlet ports may be at like pressure. The first rotor may be a male rotor and the second and third rotors may be female rotors Another aspect of the invention involves an apparatus comprising a first rotor enmeshed with second and third rotors. The rotors are held within a housing for rotation about respective first, second, and third axes. Means cooperate with the first, second, and third rotors for providing: a first volume index associated with interaction of the first and second rotors when the first rotor is driven in the first direction; and a second volume index associated with interaction of the first and third rotors when the first rotor is driven in the first direction. The second volume index is different from the first volume index.

In various implementations, the apparatus may be combined with first and second refrigerant flows along non intersecting first and second flowpaths through the apparatus. T he apparatus may be combined with first and second refrigerant flows along first and second flowpaths through the apparatus intersecting at a suction side of the apparatus. The apparatus may be combined with first and second refrigerant flows along first and second flowpaths through the apparatus intersecting at a discharge side of the apparatus.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
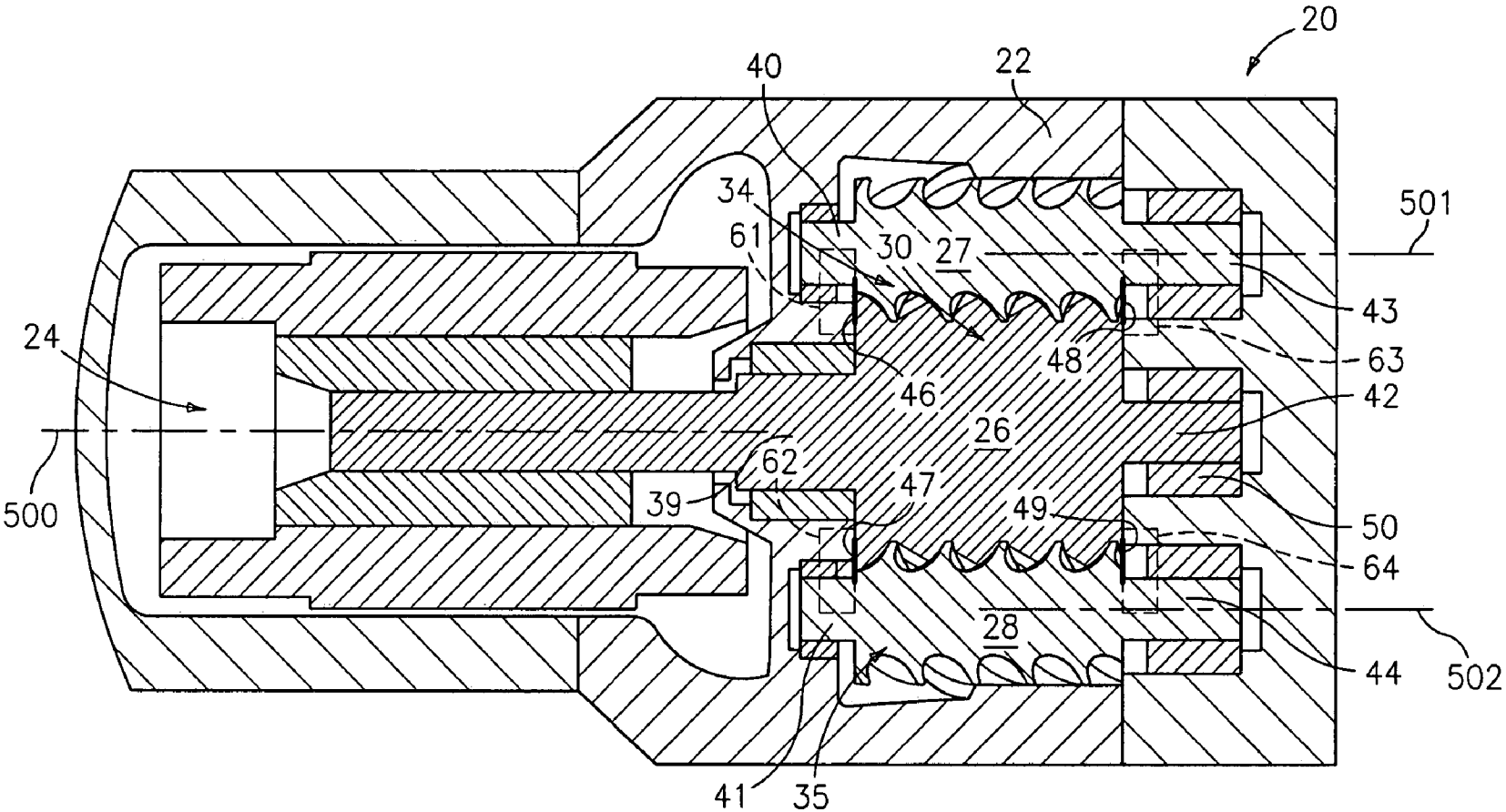
FIG. 1 is a partial semi-schematic longitudinal cutaway sectional view of a compressor.

FIG. 1 shows a compressor 20 having a housing assembly 22 containing a motor 24 driving rotors 26, 27 and 28 having respective central longitudinal axes 500, 501 and 502. In the exemplary embodiment, the male rotor 26 is centrally positioned within the compressor and has a male lobed body or working portion 30 enmeshed with female lobed body or working portion 34; 35 of each female rotor 27; 28. Each rotor includes shaft portions (e.g., stubs 39, 40, 41, and 42, 43,44 unitarily formed with the associated working portion) extending from first and second ends of the associated working portion. Each of these shaft stubs is mounted to the housing by one or more bearing assemblies 50 for rotation about the associated rotor axis.

In the exemplary embodiment, the motor 24 is an electric motor having a rotor and a stator. A portion of the first shaft stub 39 of the male rotor 26 extends within the stator and is secured thereto so as to permit the motor 24 to drive the male rotor 26 about the axis 500. When so driven in an operative first direction about the axis 500, the male rotor drives the female rotors in opposite directions about their axes 501 and 502.

Surfaces of the housing combine with the enmeshed rotor bodies to define inlet and outlet ports to a two pairs of compression pockets: a first pair of male and female compression pockets formed by the housing, male rotor, and the first female rotor; and a second pair of male and female compression pockets formed by the housing, male rotor and the second female rotor. In each pair, one such pocket is located between a pair of adjacent lobes of each rotor associated rotor. Depending on the implementation, the ports may be radial, axial, or a hybrid of the two. FIG. 1 shows first and second radial inlet ports 46 and 47 and first and second radial outlet ports 48 and 49. The resulting enmeshed rotation of the rotor working portions tends to drive fluid from a first (inlet/suction) end to a second (outlet/discharge) end while compressing such fluid. This defines a downstream direction.

According to the invention, the compression paths associated with two compression pockets do not meet at one or both of the inlet and outlet ends. In the exemplary embodiment, separate first and second inlet plenums 61 and 62 are respectively associated with the first and second pairs of compression pockets as are first and second outlet plenums 63 and 64. This may be achieved by a simple modification of the housing (e.g. a modification of an actual housing or a modification of the functional design thereof) of a conventional compressor to bifurcate one or both of an initially common suction port and an initially common discharge port. This modification may leave other components (e.g., rotors, motors, and the like) unchanged. More drastic modifications and clean sheet designs are also possible. Reuse of existing designs for varied applications can produce a variety of efficiencies (e.g., economies of scale).

Figure 2:
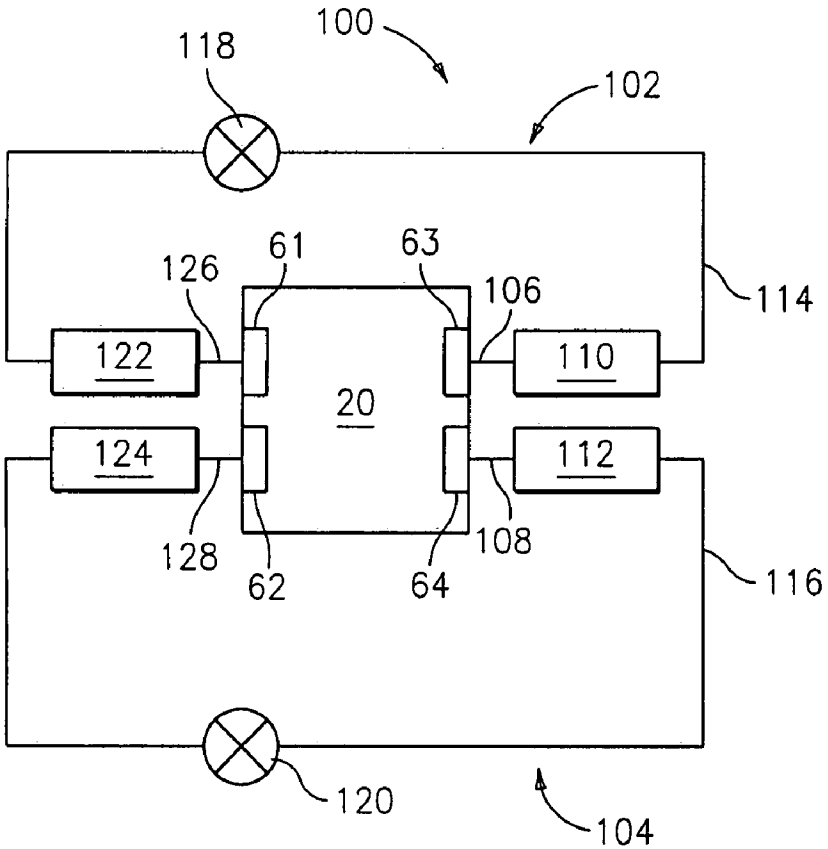
FIG. 2 is a schematic view of a first system including a compressor according to principles of the invention.

FIG. 2 shows a system 100 wherein the compressor 20 drives first and second independent refrigerant flows along first and second circuits/flowpaths 102 and 104. The first and second flowpaths each proceed downstream from the associated discharge plenum through a discharge conduit 106; 108 to a condenser 110;112. From the condenser, the flowpaths proceed through an intermediate conduit 114;116 in which a thermostatic expansion valve (TXV) 118;120 is located to an evaporator 122;124. From the evaporator, the flowpaths proceed through a suction/return conduit 126;128 to the associated inlet plenum. In normal operation, the first and second flowpaths are separate (except for incidental leakage). Such a configuration may allow one compressor and associated hardware to replace two. This causes certain direct efficiencies and indirect efficiencies (e.g., associating a larger number of uses with a given basic compressor configuration).

Figure 3:
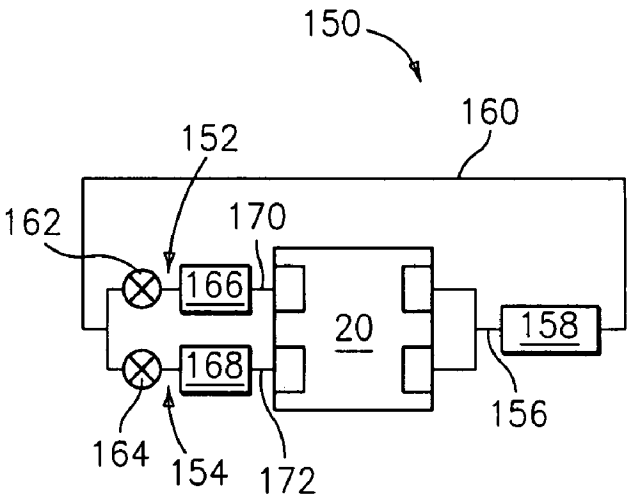
FIG. 3 is a schematic view of a second system including a compressor according to principles of the invention.

Alternative implementations may involve flowpaths that intersect at one or more individual points or overlap. FIG. 3 shows a system 150 wherein the compressor 20 drives first and second refrigerant flows along first and second circuits/flowpaths 152 and 154 that have a common upstream length and separate downstream lengths. The outlet plenums may be merged in the housing (e.g., as a single common outlet plenum) or by a T/Y-fitting in the discharge conduit 156. The combined first and second flowpaths proceed downstream through the discharge conduit to a single common condenser 158. From the condenser, the combined flowpaths proceed through the trunk of an intermediate conduit 160 which has a T/Y-fitting to separate into a first and second branches to separate the flowpaths. A TXV 162;164 is located in each branch and the associated flowpath proceeds downstream therefrom to an evaporator 166;168. From the evaporator, the flowpaths proceed through a suction/return conduit 170; 172 to the associated inlet plenum.

Figure 4:
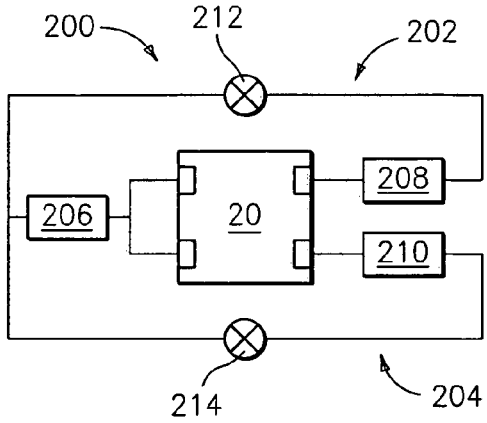
FIG. 4 is a schematic view of a third system including a compressor according to principles of the invention.

FIG. 4 shows a system 200 that may be constructed similarly to the system 150 but has first and second circuits/flowpaths 202 and 204 that have a common downstream length with a common evaporator 206 and separate upstream lengths with separate condensers 208 and 210 and TXVs 212 and 214.

Figure 5:
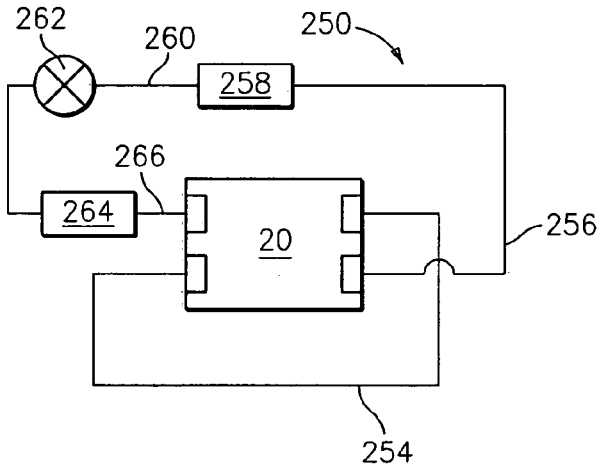
FIG. 5 is a schematic view of a fourth system including a compressor according to principles of the invention.

FIG. 5 shows a system 250 that has a single flowpath 252 in which the two compression paths are in series. The flowpath proceeds downstream from the first outlet plenum through a conduit 254 to the second inlet plenum. From the second outlet plenum, the flowpath proceeds through a discharge conduit 256 to a condenser 258. From the condenser, the flowpath proceeds through an intermediate conduit 260 in which a TXV 262 is located to an evaporator 264. From the evaporator, the flowpath proceed through a suction/return conduit 266 to the first inlet plenum.

Figure 6:
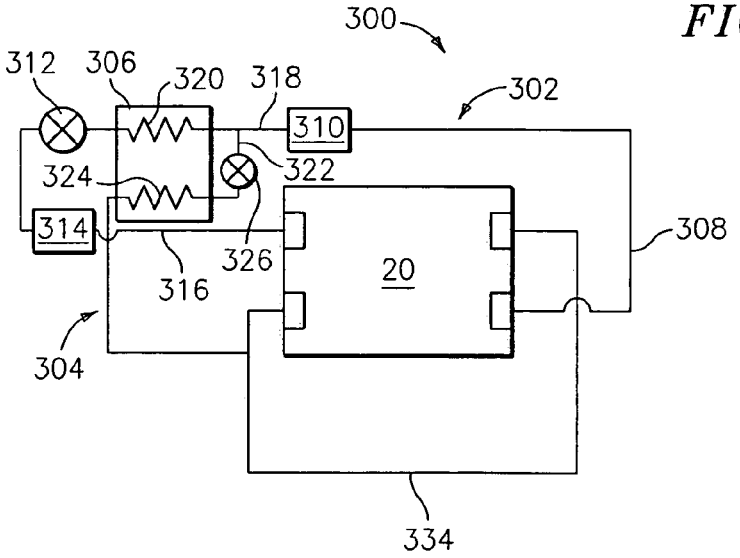
FIG. 6 is a schematic view of a fifth system including a compressor according to principles of the invention.

In a variation on the basic two-stage system of FIG. 5, FIG. 6 shows a system 300 that has a flowpath 302 providing a selective diversion along a diversion path 304 passing within an ecomomizer heat exchanger (HE) 306. A discharge conduit 308, condenser 310, TXV 312, evaporator 314, and suction/return conduit 316 may be similar to corresponding elements of the system 250. The intermediate conduit 318 includes a portion 320 within the HE. A diversion conduit 322 branches from the intermediate conduit between the condenser and HE to define the diversion path 304. The diversion conduit includes a portion 324 within the HE in heat exchange relation (e.g., parallel flow, counterflow, or crossflow) with the portion 320. A diversion TXV 326 is located in the diversion conduit to control the diversion flow. The diversion conduit joins the conduit 334 that feedsback from the first outlet plenum to the second inlet plenum.

One or more embodiments of the present invention have been described. Nevertheless, it will be understood that various modifications may be made without departing from the spirit and scope of the invention. For example, additional features may be included as are known in the art or are subsequently developed. Accordingly, other embodiments are within the scope of the following claims.

What is claimed is:

1. A system comprising:

a compressor comprising:

a housing;

a first rotor held by the housing for rotation about a first axis;

a second rotor held by the housing for rotation about a second axis;

a third rotor held by the housing for rotation about a third axis;

a first compression path having suction and discharge ends; end a second compression path, independent of the first compression path and having suction and discharge ends;

at least one condenser;

at least one expansion device;

at least one evaporator; and a plurality of conduits coupling the compressor, the at least one condenser the at least one expansion device, and the at least one evaporator so as to define first and second at least partially separate circuits respectively associated with the first and second compression paths, wherein at least one of:

the discharge end of the first compression path is at a different pressure than the discharge end of the second compression path; and the suction end of the first compression path is at a different pressure than the suction end of the second compression path.

2. The system of claim 1 wherein:

the first compression path is associated with the first rotor and the second rotor; and the second compression path is associated with the first rotor and the third rotor.

3. The system of claim 1 wherein:

the discharge end of the first compression path is at the same pressure as the suction end of the second compression path.

4. The system of claim 1 wherein the at least one condenser includes a first condenser;

the at least one expansion device includes a first expansion device;

the at least one evaporator includes a first evaporator; and the plurality of conduits includes one or more first conduits coupling the first condenser, the first expansion device and the first evaporator to the housing to define a first flowpath from the discharge end of the second compression path to the suction end of the first compression path.

5. The cooling system of claim 1 wherein:

said at least one condenser includes first and second condensers;

said at least one expansion device includes first and second expansion devices;

said at least one evaporator includes first and second evaporators;

the first condenser, first expansion device, and first condenser are along the first circuit; and the second condenser, second expansion device, and second condenser are along the second circuit.

6. The cooling system of claim 5 wherein:

the first and second circuits are non-intersecting.

7. An apparatus comprising:

a housing;

a first rotor held within the housing for rotation about a first axis;

a second rotor enmeshed with the first rotor and held within the housing for rotation about a second axis;

a third rotor enmeshed with the first rotor and held within the housing for rotation about a third axis;

a first condenser a first evaporator;

one or more first conduits coupling the first condenser and the first evaporator to the housing;

a second condenser:

a second evaporator, and one or more second conduits coupling the second condenser and the second evaporator to the housing, wherein:

housing comprises:

a first surface cooperating with the first and second rotors to define a first inlet port;

a second surface cooperating with the first and second rotors to define a first outlet port;

a third surface cooperating with the first and third rotors to define a second inlet port; and a fourth surface cooperating with the first and third rotors to define a second outlet port;

the one or more first conduits define a first flowpath from the first outlet port through the first evaporator and first condenser and to the first inlet port the one or more second conduits define a second flowpath from the second outlet Port through the second evaporator and second condenser and to the second inlet port; and at least one of: the first and second inlet ports are at a different pressure than each other; and the first and second outlet ports are at a different pressure than each other.

8. The apparatus of claim 7 wherein:

the first outlet port is at the same pressure at the second inlet port.

9. The apparatus of claim 7 wherein:

there are no economizer branches off the first flowpath.

10. The apparatus of claim 7 further comprising:

an economizer heat exchanger having:

a first leg along the first flowpath; and a second leg, in heat exchange relation with the first leg, the second leg being along a diversion flowpath from a location along the first flowpath between the first condenser and the first leg to join a second flowpath from the first outlet port to the second inlet port.

11. The apparatus of claim 7 wherein either:

the first and second inlet ports are at like pressure; or the first and second outlet ports are at like pressure.

12. The apparatus of claim 7 wherein either:

the first and second inlet ports form a common inlet port; or the first and second outlet ports form a common outlet port.

13. The apparatus of claim 7 wherein:

the first rotor is a male rotor, and the second and third rotors are female rotors.

14. The apparatus of claim 7 further comprising:

a first expansion device along the first flowpath; and a second expansion device along the second flowpath.

15. An apparatus comprising:

a first rotor held for rotation in at least a first direction about a first axis;

a second rotor enmeshed with the first rotor and held for rotation about a second axis;

a third rotor enmeshed with the first rotor and held for rotation about a third axis;

means cooperating with the first, second, and third rotors for providing;

a first volume index associated with interaction of the first and second rotors when the first rotor is driven in the first direction; and a second volume index associated with interaction of the first and third rotors when the first rotor is driven in the first direction, the second volume index different from the first Volume index; and first and second refrigerant flows along non-intersecting first and second flowpaths through the apparatus.

16. The apparatus of claim 15 wherein the first and second flowpaths through the apparatus intersect at a suction side of the apparatus.

17. The apparatus of claim 15 wherein the first and second flowpaths through the apparatus intersect at a discharge side of the apparatus.

18. The apparatus of claim 15 further comprising:

a first evaporator along the first flowpath; and a second evaporator along the second flowpath.

19. The apparatus of claim 15 feather comprising:

a first condenser along the first flowpath; and a second condenser along the second flowpath.

20. The apparatus of claim 19 further comprising:

a first evaporator along the first flowpath; and a second evaporator along the second flowpath.

* * * * *

UNITED STATES PATENT AND TRADEMARK OFFICE

CERTIFICATE OF CORRECTION

PATENT NO. : 7,178,352 B2
APPLICATION NO. : 10/821097
DATED : February 20, 2007
INVENTOR(S) : Alexander Lifson It is certified that error appears in the above-identified patent and that said Letters Patent is hereby corrected as shown below:

In column 5, claim 1, line 24, “end” should be deleted.

In column 5, claim 1, line 32, a --,-- should be inserted after “condenser”.

In column 5, claim 4, line 52, a --:-- should be inserted after “wherein”.

In column 6, claim 7, line 17, a --;-- should be inserted after “condenser”.

In column 6, claim 7, line 21, delete the “:” and insert a --;--.

In column 6, claim 7, line 22, delete the “,” and insert a --;--.

In column 6, claim 7, line 26, before “housing” --the-- should be inserted.

In column 6, claim 7, line 39, “Port” should read --port--.

In column 6, claim 8, line 47, after “pressure” “at” should be deleted and --as-- should be inserted.

In column 7, claim 13, line 2, after “rotor” delete the “,” and insert a --;--.

In column 7, claim 15, line 15, delete the “;” and insert a --:--.

In column 8, claim 15, line 1, “Volume” should read --volume--.

UNITED STATES PATENT AND TRADEMARK OFFICE

CERTIFICATE OF CORRECTION

PATENT NO. : 7,178,352 B2
APPLICATION NO. : 10/821097
DATED : February 20, 2007
INVENTOR(S) : Alexander Lifson It is certified that error appears in the above-identified patent and that said Letters Patent is hereby corrected as shown below:

In column 8, claim 19, line 14, “feather” should read --further--.

Signed and Sealed this

Eighteenth Day of December, 2007

JON W. DUDAS
*Director of the United States Patent and Trademark Office*